US005375667A

United States Patent [19]

Trevisani

[11] Patent Number: 5,375,667

[45] Date of Patent: Dec. 27, 1994

[54] STOWING AND HANDLING SYSTEM FOR RODS USED IN DRILLING RIGS

[75] Inventor: Davide Trevisani, Cesena, Italy

[73] Assignee: Soilmec S.P.A., Cesena, Italy

[21] Appl. No.: 117,983

[22] Filed: Sep. 8, 1993

[30] Foreign Application Priority Data

Sep. 27, 1992 [IT] Italy ..... TO.92-U/000228

[51] Int. Cl.[5] ..... E21B 19/15

[52] U.S. Cl. ..... 175/52; 175/85; 414/22.56; 414/22.65

[58] Field of Search ..... 175/52, 85; 414/22.65, 414/22.54, 22.55, 22.56, 22.63, 22.51, 22.62

[56] References Cited

U.S. PATENT DOCUMENTS

| | | | |
|---|---|---|---|
| 3,443,647 | 5/1969 | Jenkins et al. | 175/85 |
| 3,851,770 | 3/1974 | Jenkins et al. | 214/2.5 |
| 4,020,909 | 3/1977 | Airaudo | 173/147 |
| 4,036,508 | 7/1977 | Eddy et al. | 280/492 |
| 4,434,860 | 6/1984 | Deyo | 173/147 |

FOREIGN PATENT DOCUMENTS

| | | | |
|---|---|---|---|
| 1170016 | 7/1984 | Canada . | |
| 0548900 | 6/1993 | European Pat. Off. . | |
| 2092611 | 1/1972 | France . | |
| 2644508 | 9/1990 | France | 414/22.51 |
| 2079817 | 1/1982 | United Kingdom . | |
| 2083106 | 3/1982 | United Kingdom | 175/52 |
| 1121381 | 10/1984 | U.S.S.R. | 175/52 |
| 1460186 | 2/1989 | U.S.S.R. | 175/52 |

*Primary Examiner*—Hoang C. Dang

*Attorney, Agent, or Firm*—Merchant & Gould Smith, Edell, Welter & Schmidt

[57] ABSTRACT

A system for stowing and handling rods (50) for use in drilling rigs (110) comprising a drilling tower (122) with a driving head (130) movable between a borehole and a service well (151) for taking up and depositing the drilling rods. The system comprises:

a rigid base (62) provided with a plurality of hinging seats (78);

a plurality of rod containers (61), each provided at its foot (73) with hinge pins (73,79) for its rapid hinging to the base (62);

a jib crane (63), a cable (80) and a coupling device (81) for rotating the containers (61) in a vertical plane between a substantially vertical operating position and a lying-down position (61') for their assembly and disassembly. The crane (63), cable (80) and coupling device (81) are mounted on the drilling rig (110), for withdrawing the rods (50) from the containers (61).

7 Claims, 2 Drawing Sheets

STOWING AND HANDLING SYSTEM FOR RODS USED IN DRILLING RIGS

This invention falls within the field of drilling rigs, and more particularly relates to a system for stowing and handling the drill rods.

Among the known systems of mounting the single rods on the drill stem working in a drill rig, there is that of digging a well immediately adjacent to the borehole. The rods are taken up one by one from said well to be fitted to the driving head. The latter is lifted upwards with the new rod and shifted above the borehole. Then, the new rod is connected to the ones already working and a new portion of the borehole is drilled, the depth of which corresponds to the length of the last rod that has been mounted.

It is an object of this invention to provide a system for handling the rod mounting and removal operations in an ordered and rapid manner during the respective drilling of the well and the rod extraction when the well is complete.

A further object of the invention is to provide a rod collection arrangement to enable the rods to be comfortably transported from one site to the next, in a manner already ordered and ready for use.

These and further objects and advantages, which will be more apparent hereinafter are attained according to the invention by a system for stowing and handling rods for use in drilling rigs comprising a drilling tower with a driving head movable between a borehole and a service well for taking up and depositing the drilling rods, comprising:

a rigid base provided with a plurality of hinging seats;

a plurality of rod containers, each provided at its foot with corresponding means for its rapid hinging to said base;

means for rotating the containers in a vertical plane between a substantially vertical operating position and a lying-down position for their assembly and disassembly;

lifting means, mounted on the drilling rig, for withdrawing the rods from said containers.

Figure 1:
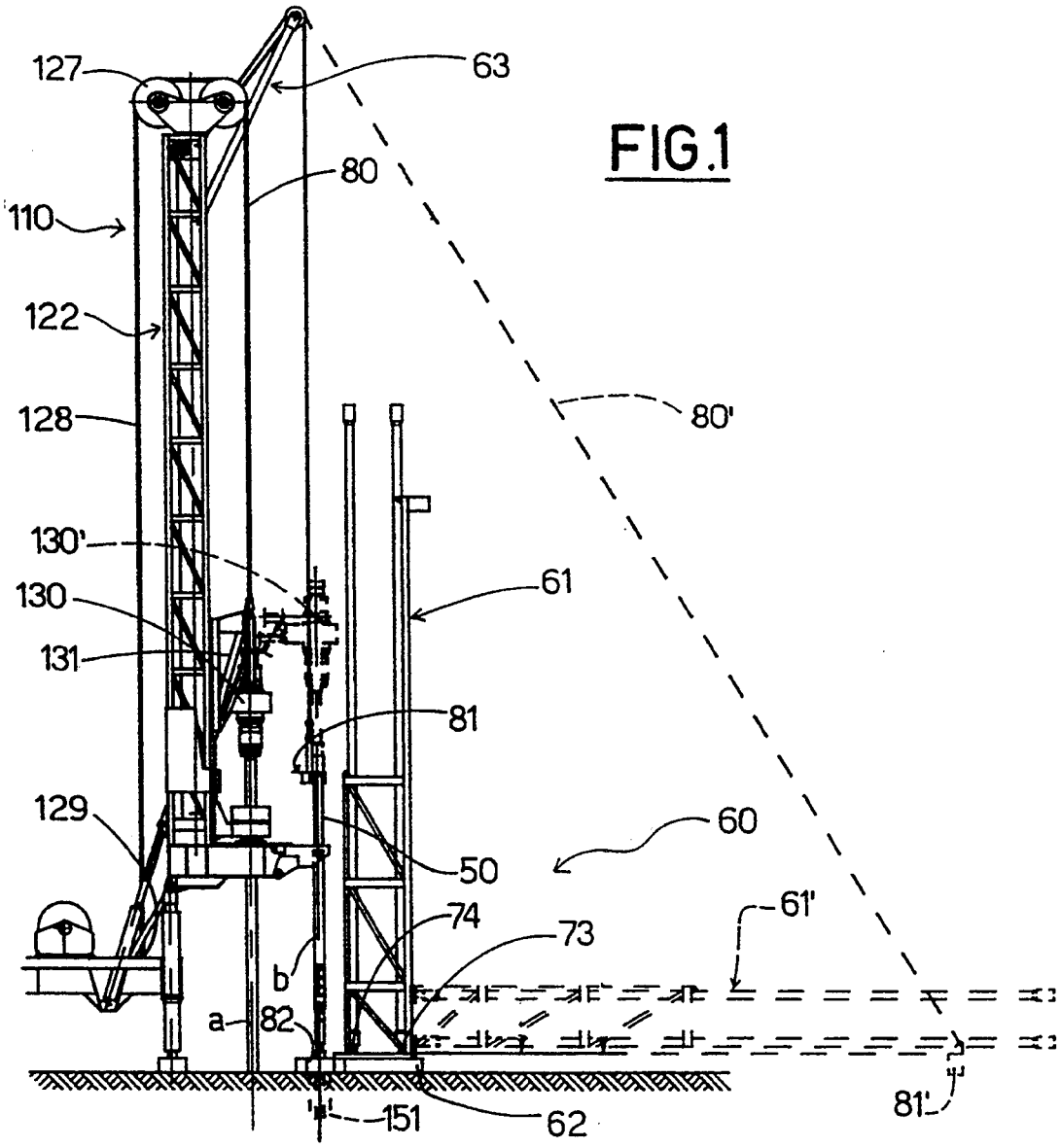
Figure 3:
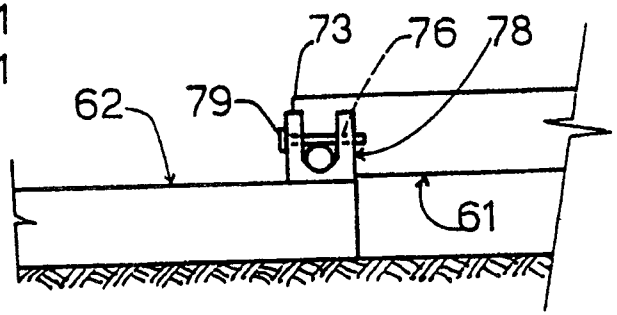
Figure 2:
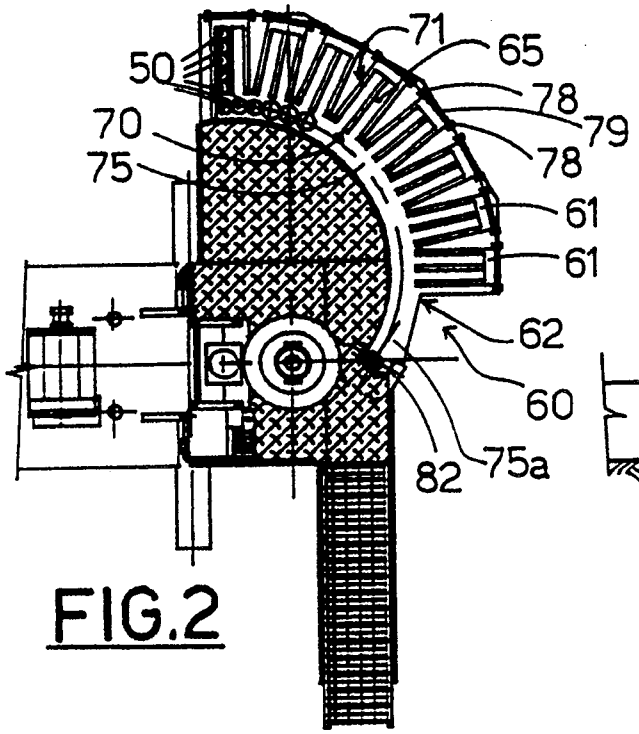

A preferred but not-limiting embodiment of the system according to the invention is described hereinafter with reference to the enclosed drawings, in which:

FIGS. 1 and 2 are respectively an elevation and plan view of a rod stowing and handling arrangement according to the invention; and FIG. 3 is a view of a detail of FIG. 1 to an enlarged scale.

With reference to FIG. 1, a drilling rig is indicated overall by numeral 110. As this rig is not the object of this invention, it will be hereinafter described very briefly. The rig comprises a drilling tower 122; a cable, chain or other flexible transmission means 128 passes about upper end pulleys 127 on the tower 122 and has one end fixed at 129 to the rig and its other end supporting a driving head 130 of traditional type in which the drilling rods 50 are clamped.

A frame 131 supports the driving head 130 via an articulated quadrilateral linkage that allows the head to move from the vertical line "a" corresponding to the axis of the borehole (not shown for simplicity), to the vertical line "b" coaxial with a service well 151 for resting or taking up the drilling rods.

According to the present invention, a drilling rod stowing and handling system, indicated overall by the reference numeral 60, is combined with the drilling rig 110. This system is composed essentially of a plurality of tiltable containers of lattice type 61, a base 62 and a lifting jib crane 63.

In the embodiment shown in the drawings, the base is of arched shape in plan view, however it can be of different configuration depending on working requirements.

The base 62, in the form of a rigid platform, is arranged in the immediate vicinity of the drilling rig close to the borehole and the service well. Each container 61 has a rear or outer side 70, from which there extend three parallel branches 71 which define between them a pair of chambers or compartments 65 open in the direction of the drilling rig and able to receive two corresponding rows of drilling rods 50. As can be seen from FIG. 2, in which the various containers are shown in their raised position, the foot 73 of each of them is hinged to the base 62 at the outer periphery thereof so that the containers can be arranged radially about the base 62 when in the lying position (FIG. 1, position shown by dashed lines 61').

With reference to FIG. 3, during assembly the containers 61 can be rapidly hinged to the base 62 by resting the feet 73 of each container on appropriate seats 78 and inserting a pin 79 through a hole 76 provided in the hinge seats 78, which are fixed in pairs along the outer periphery of the base.

The base 62 is suitably dimensioned so that when the containers 61 are in their erect position, an inner track 75 is left free for the passage of the rods. In one end 75a of the track there is a circular hole 82 of slightly larger diameter than the rods 50. The base 62 is arranged to the side of the drilling rig such that the hole 82 corresponds with the service well 151.

Again with reference to FIG. 1, the jib crane 63 is mounted at the top of the drilling tower 122 and by means of a cable 80 supports a coupling device 81. This can be used both to carry the individual rods 50 from the containers 61 to the service well 151 and vice versa, and for hooking the top of the containers 61' when in their lying position and raising them into their erect position, or lying them on the ground on finishing boring.

The operation of the system according to the invention is as follows: the containers 61, complete with drilling rods 50, are firstly laid down on the ground with their feet 73 on the outer edge of the base. These are then connected to the base by inserting the pins 79 into the corresponding holes 76.

At this point the containers 61 can be raised into their working position either by the service crane 63, as shown in FIG. 1, or by other site service cranes (not shown). When the containers are in their erect position, their front feet 74 are locked to the base by quick locking means of known type and therefore not described or illustrated for simplicity. At this point the Jib crane 63 is operated to move the coupling device 81 to one of the rods 50 contained in a container 61. The rod is coupled and extracted from the container.

Then, by rotating the crane about the drilling tower, the rod 50 is dragged along the track 75 as far as its end 75a and is then let into the service well 151. From there the rod is taken by the driving head 130' of the drilling rig and moved into a position coaxial with the vertical line "a" through the centre of the borehole, where it is screwed to the already operating drill stem.

The reverse procedure is followed to extract the drill stem from the borehole. The rods are carried one by one to the service well and from there to the containers by the crane 63. As soon as the container is full of rods, it can be laid down horizontally and then loaded onto a transporting vehicle intended for another site.

The invention is not limited to the aforegoing description, which is to be considered purely as an illustration of the best mode of implementing the equipment, and modifications in the terms of the shape, dimensions, and arrangements of the parts and of the constructional and operational details. For example the base can be straight instead of arched, with the containers being consequently of comb arrangement when laid on the ground. The invention includes all modifications which fall within its scope, as defined by the following claims.

I claim:

1. A system for stowing and handling rods for use in drilling rigs comprising a drilling tower with a driving head movable between a borehole and a service well for taking up and depositing the drilling rods, comprising:

a rigid base provided with a plurality of hinging seats;

a plurality of rod containers, each provided at a foot with corresponding means for its rapid hinging to said base;

means for rotating the containers in a vertical plane between a substantially vertical operating position and a lying-down position for their assembly and disassembly;

lifting means, mounted on the drilling rig, for withdrawing the rods from said containers.

2. A system as claimed in claim 1, wherein said lifting and rotating means comprise a single jib crane mounted on the drilling rig and supporting, by means of a cable, a coupling device for the rods and the containers.

3. A system as claimed in claim 2, wherein said containers comprise lattices with a comb-shaped cross-section defining compartments open towards the drilling rig and arranged to receive corresponding rows of rods.

4. A system as claimed in claim 1, wherein said hinging seats are fixed in pairs to at least one side of said base, said hinging means including pins to be inserted through holes provided in the seats in correspondence with one side of the foot of the containers.

5. A system as claimed in claim 1, wherein said base comprises, for the passage of the rods, a track provided on the opposite side to that on which the containers are hinged.

6. A system as claimed in claim 5, wherein at one end of said track there is provided in the base a hole for passage of the rods, the base being positioned proximate to the drilling rig such that said hole is coaxial with the vertical axis through the service well.

7. A system as claimed in claim 6, wherein said base has a plan shape in the form of an arch, said rod containers being hinged to its outer edge, and said rod passage track being adjacent to its inner edge.

* * * * *